US008617659B2

(12) United States Patent
Domey et al.

(10) Patent No.: US 8,617,659 B2
(45) Date of Patent: Dec. 31, 2013

(54) METHODS OF APPLYING A LAYER TO A HONEYCOMB BODY

(75) Inventors: Jeffrey John Domey, Elmira, NY (US); John Edmond Graham, Corning, NY (US)

(73) Assignee: Corning Incorporated, Corning, NY (US)

( * ) Notice: Subject to any disclaimer, the term of this patent is extended or adjusted under 35 U.S.C. 154(b) by 908 days.

(21) Appl. No.: 12/231,140

(22) Filed: Aug. 29, 2008

(65) Prior Publication Data

US 2010/0055332 A1 Mar. 4, 2010

(51) Int. Cl.
*B05D 3/12* (2006.01)
*B05D 1/40* (2006.01)

(52) U.S. Cl.
USPC ..... 427/356; 118/56; 118/107; 118/232; 427/240; 427/425

(58) Field of Classification Search
USPC ..... 427/356, 355, 357; 118/232, 52, 56, 118/100, 107, 112, 200, 206, 209, 210, 242, 118/320, 321
See application file for complete search history.

(56) References Cited

U.S. PATENT DOCUMENTS

| | | | | |
|---|---|---|---|---|
| 5,357,857 | A | 10/1994 | Zimmer | 13/4 |
| 5,749,970 | A | 5/1998 | Fukuta et al. | 13/4 |
| 6,555,162 | B1 | 4/2003 | Takimoto et al. | 1/42 |
| 6,841,196 | B2 | 1/2005 | Takimoto et al. | 3/12 |
| 2005/0112278 | A1* | 5/2005 | Obata et al. | 427/231 |
| 2005/0249877 | A1 | 11/2005 | Noro et al. | 11/2 |
| 2006/0102070 | A1* | 5/2006 | Noro et al. | 118/100 |
| 2006/0178258 | A1* | 8/2006 | Gadkaree et al. | 501/124 |

* cited by examiner

*Primary Examiner* — Alexander Weddle
(74) *Attorney, Agent, or Firm* — Charles A. Greene; Matthew J. Mason

(57) ABSTRACT

Methods are provided for applying a layer to a honeycomb body. The methods include the steps of applying a cement mixture to a cylindrical surface of the honeycomb body and rotating the honeycomb body and a blade relative to one another about a longitudinal axis of the honeycomb body. The methods further include the steps of holding the blade at a first interior angle during a relative rotation of the honeycomb body and the blade about the longitudinal axis. The methods then include the step of moving the blade from the first interior angle to a second interior angle greater than the first interior angle. The methods still further include the step of rotating of the honeycomb body and the blade relative to one another about the longitudinal axis after the blade begins to move from the first interior angle toward the second interior angle.

24 Claims, 10 Drawing Sheets

METHODS OF APPLYING A LAYER TO A HONEYCOMB BODY

TECHNICAL FIELD

The present invention relates generally to methods of applying a layer to a honeycomb body, and more particularly, to methods of applying a cement mixture to the surface of a honeycomb body.

BACKGROUND

It is known to produce honeycomb bodies of ceramic material. It is also known to apply a cement mixture to an outer cylindrical surface of a honeycomb body.

SUMMARY

In accordance with one aspect, a method is provided for applying a layer to a honeycomb body with a longitudinal axis extending through opposing end faces and a cylindrical surface extending about the longitudinal axis and between the end faces. The method includes the steps of applying a cement mixture to the cylindrical surface and rotating the honeycomb body and a blade relative to one another about the longitudinal axis. The method further includes the steps of contacting the cement mixture with the blade while the honeycomb body and the blade rotate relative to one another. A working edge of the blade is disposed in proximity to the cylindrical surface and contacts the cement mixture along a contact line transverse to a relative rotation direction. The blade forms a first interior angle with the cylindrical surface in an upstream direction from the contact line. The method further includes the step of holding the blade at the first interior angle during a relative rotation of the honeycomb body and the blade about the longitudinal axis. Then, the blade is moved from the first interior angle to a second interior angle with the cylindrical surface in the upstream direction from the contact line. The second interior angle is greater than the first interior angle. The method further includes the step of rotating of the honeycomb body and the blade relative to one another about the longitudinal axis after the blade begins to move from the first interior angle toward the second interior angle.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

Figure 1:
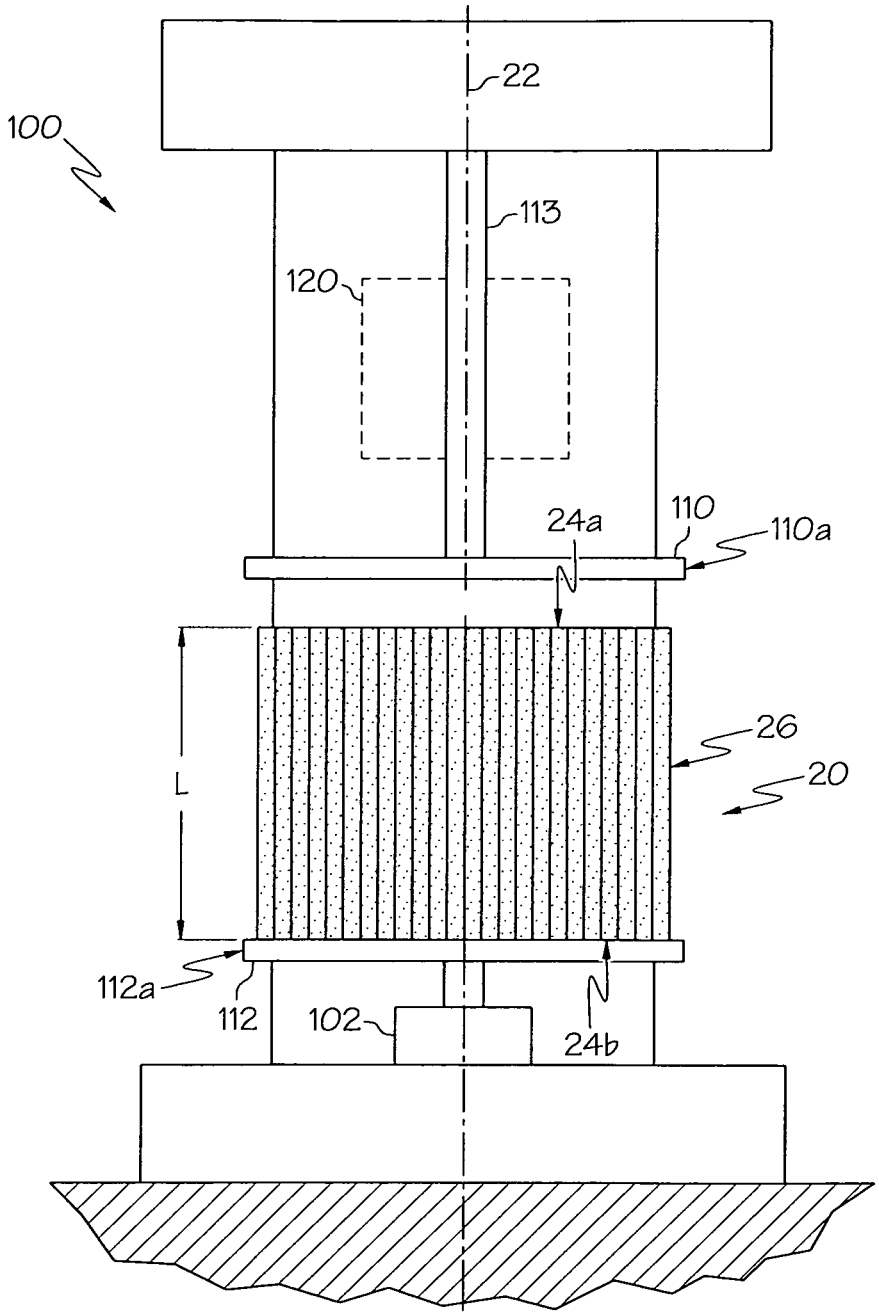
FIG. 1 is a schematic view of an apparatus with a honeycomb body with end faces positioned between corresponding support members of the apparatus.

The present invention will now be described more fully hereinafter with reference to the accompanying drawings in which example embodiments of the invention are shown. However, this invention may be embodied in many different forms and should not be construed as limited to the embodiments set forth herein. Like reference numbers refer to like elements throughout the various drawings.

As set forth in the drawings, example methods of applying a layer to a honeycomb body 20 are disclosed. Honeycomb bodies can be used in various filtering applications. For instance, honeycomb bodies can be used as a particulate filter for processing exhaust from a combustion engine. In some examples, the honeycomb bodies may be loaded with a catalyst to reduce nitrogen oxide compounds or other environmental pollutants. Various materials may be used to form the honeycomb bodies. For instance, honeycomb bodies may be comprised of ceramic material such as cordierite, mullite, silicon carbide, aluminum titanate or other materials or combinations thereof. During production of the ceramic honeycomb body, raw materials such as inorganic materials a liquid vehicle and a binder are mixed into a batch. The batch is then extruded into a green honeycomb body. The green body can then be heated to be dried and further heated and processed into a fired honeycomb body of refractory material, such as ceramic.

The honeycomb body can comprise various structural configurations depending on the particular application. For example, as shown in FIG. 1, the honeycomb body 20 can include a longitudinal axis 22, such as the illustrated symmetrical axis, extending through opposing end faces 24*a*, 24*b*. As shown, each of the end faces 24*a*, 24*b* can be substantially planar but may have different configurations in further examples. As further illustrated, the end faces 24*a*, 24*b* can be substantially parallel to one another although the end faces may extend at an angle to one another in further examples. Still further, one or both of the end faces 24*a*, 24*b* can be substantially perpendicular to the longitudinal axis 22 as shown in FIG. 1.

The honeycomb body can further include various shapes and sizes. For instance, as shown in FIGS. 1-5, the honeycomb body 20 can have a length "L" approximately equal to an outer dimension "d" although the length "L" may be substantially greater or less than the outer dimension "d" in further examples. The honeycomb bodies can also include a cylindrical surface extending about the longitudinal axis between the end faces. In examples, the cylindrical surface can have a cross sectional shape substantially equal or geometrically similar to the peripheral shape of at least one of the end faces 24*a*, 24*b*.

Figure 5:
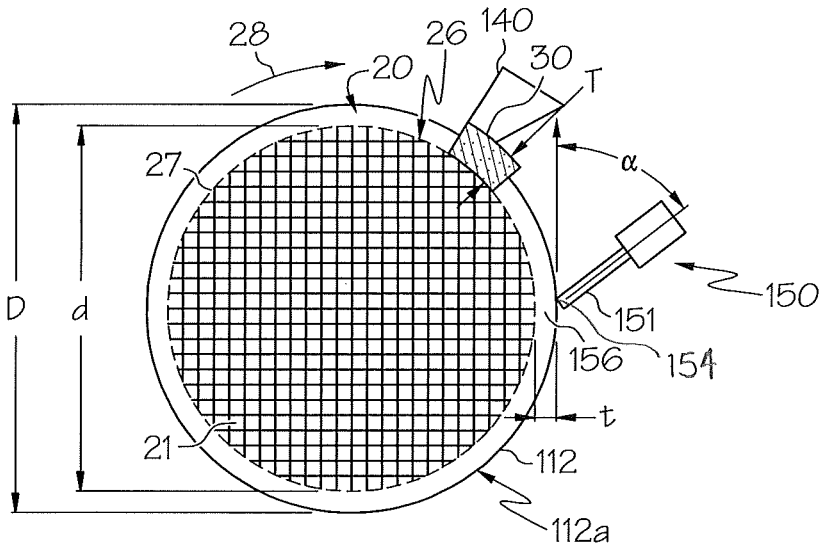
FIG. 5 is a sectional view of the apparatus and honeycomb body along line 5-5 of FIG. 2 illustrating the blade forming a first interior angle with the cylindrical surface in an upstream direction from a contact line.

The illustrated honeycomb body 20 includes a cylindrical surface 26 extending about the longitudinal axis 22 between the end faces 24*a*, 24*b*. As shown in FIG. 5, the cylindrical surface 26 has a cross section with a substantially circular periphery wherein the outer dimension "d" comprises the diameter of the circle. As shown, the actual cylindrical surface can comprise exposed portions of partial channels 21 although a substantially continuous cylindrical surface may be provided in further examples which can depend on the extrusion die configuration. A broken line 27 is shown in FIGS. 5-8 indicating the outer dimension "d" of the cylindrical surface 26. Although not shown, the cylindrical surface can comprise an oval shape or other curvilinear shape. In further examples, the cylindrical surface may have a triangular, rectangular or other polygonal shape.

As further illustrated in FIG. 5, the honeycomb body includes channels 21 extending along a direction of the longitudinal axis 22. In further examples, the channels may extend along other directions to provide communication between the end faces 24*a*, 24*b*. As shown, the channels 21 can be provided as a matrix of channels defined by adjacent sidewalls. The illustrated sidewalls provide each interior channel with a substantially square shape. In further examples, the channels can comprise circular, oval or other curvilinear shape. In still further examples, the channels can comprise other polygonal shapes with three or more sides.

The figures illustrate various methods for applying a layer to honeycomb bodies. While the methods are described with reference to the illustrated honeycomb body 20, methods may be used to apply a layer to other honeycomb bodies. The methods include the step of applying a cement mixture 30 to the cylindrical surface 26. For instance, as shown in FIG. 5, a dispensing device 140 can be used to apply an appropriate amount of cement mixture 30 to the cylindrical surface 26. Examples of the dispensing device 140 can extend along substantially the entire length "L" of the honeycomb body 20. In further examples, the dispensing device 140 may have a length less than the length of the honeycomb body. In one example, the dispensing device 140 may be disposed in proximity to the cylindrical surface such that the cement mixture 30 can be applied directly to the cylindrical surface. Moreover, the dispensing device 140 can be located toward the top of the cylindrical surface to allow gravity to help spread the cement mixture 30 during the application procedure. The cement mixture 30 can be initially applied in bulk with a depth "T" that may be substantially the same or consistent during application. The cement mixture 30 may be applied to the cylindrical surface 26 over at least part of the length "L" such as the entire length "L" of the honeycomb body 20. The cement mixture 30 can comprise various materials and may be formed from substantially the same material as the honeycomb body 20 or the materials from which the body 20 is formed, such as inorganic materials, a binder and/or a liquid vehicle.

Figure 2:
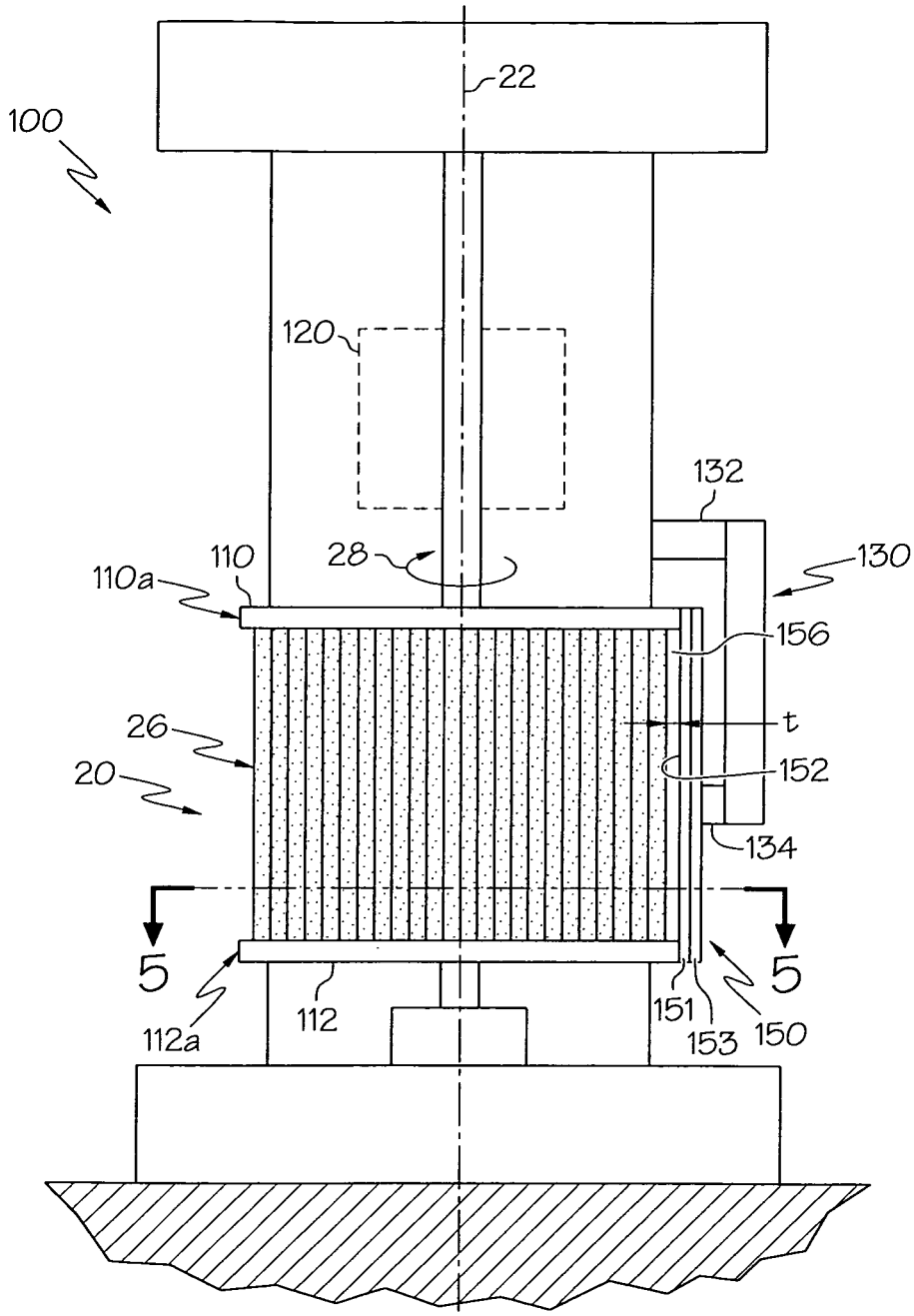
FIG. 2 is a schematic view of FIG. 1 with the support members of the apparatus gripping the end faces of the honeycomb body and the apparatus rotating the honeycomb body about a longitudinal axis with a working edge of a blade being positioned in proximity to a cylindrical surface of the honeycomb body.

The method can include the step of rotating the honeycomb body 20 and a blade 150 relative to one another about the longitudinal axis 22. For example, as shown in FIG. 2, the method can include the step of rotating the honeycomb body 20 relative to the blade 150 about the longitudinal axis 22. As shown, the blade 150 may remain substantially stationary relative to a base of an apparatus 100 while the honeycomb body 20 rotates relative to the base of the apparatus. In further examples, the blade 150 may orbit about the honeycomb body 20 while the honeycomb body 20 remains substantially stationary relative to the base. In still further examples, the blade 150 may orbit about the honeycomb body 20 while the honeycomb body 20 rotates relative to the base.

The honeycomb body 20 and/or the blade 150 can be rotated at various rotation speeds. The rotation speeds may be constant, changing (e.g., stepped or continuously changing), and/or comprise a series of incremental rotations. In further examples, the longitudinal axis 22 can comprise the symmetrical axis of the honeycomb body 20.

In further examples, the method can include the step of applying the cement mixture 30 while the honeycomb body 20 and the blade 150 remains stationary or during rotation of the honeycomb body 20 and the blade 150 relative to one another. For instance, as shown in FIG. 5, the dispensing device 140 can apply the cement mixture 30 while rotating the honeycomb body 20. As the honeycomb body 20 rotates, the cement mixture 30 is carried away from the dispensing device 140 in the relative rotation direction 28. As the applied cement mixture 30 is carried away, the dispensing device 140 can continue to apply an appropriate amount of cement mixture 30 to the cylindrical surface 26. In further examples, the dispensing device 140 can apply the cement mixture 30 while the dispensing device 140 orbits the honeycomb body. For instance, the dispensing device 140 can orbit while the honeycomb body 20 remains stationary relative to the base of the apparatus 100.

Methods of the present invention can further include the step of contacting the cement mixture 30 with the blade 150 while rotating the honeycomb body 20 and the blade 150 relative to one another about the longitudinal axis 22. For example, the blade 150 may initially contact the cement mixture 30 with no relative rotation between the honeycomb body 20 and the blade 150 and then continue to contact the cement mixture 30 during relative rotation between the honeycomb body 20 and the blade 150 about the longitudinal axis 22. In further examples, the blade 150 initially contacts the cement mixture while the honeycomb body 20 and the blade 150 rotate relative to one another about the longitudinal axis 22 and then continues to contact the cement mixture 30 during subsequent relative rotation of the honeycomb body 20 and the blade 150 about the longitudinal axis 22.

Figure 6:
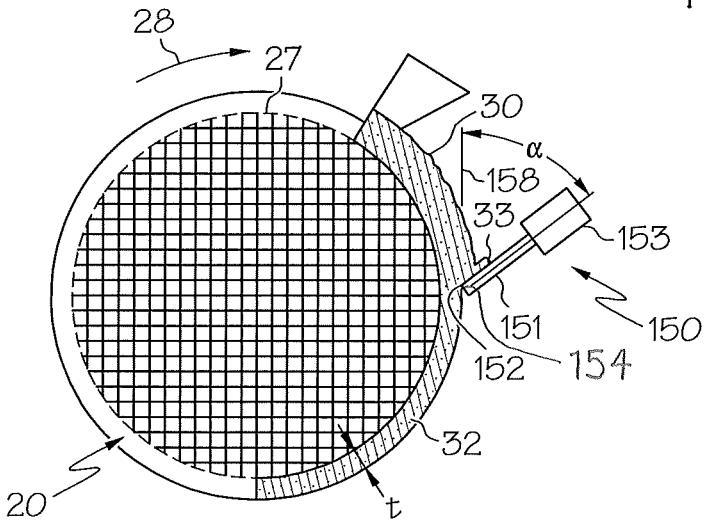
FIG. 6 is a sectional view of the apparatus and honeycomb body along line 6-6 of FIG. 3 illustrating a cement mixture layer being formed on the cylindrical surface of the honeycomb body.
Figure 7:
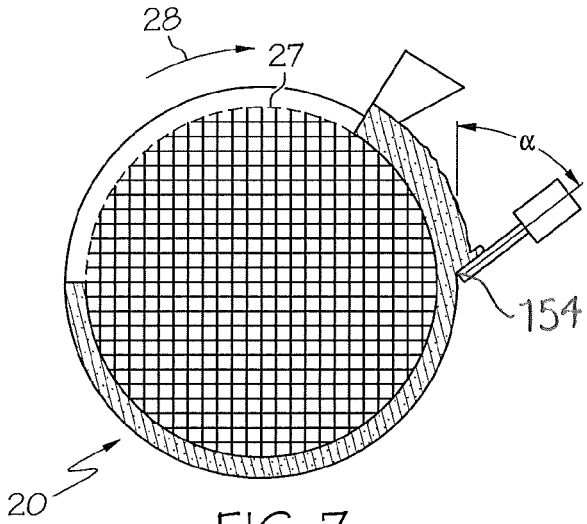
FIG. 7 is a sectional view of the apparatus and honeycomb body along line 7-7 of FIG. 4.
Figure 13:
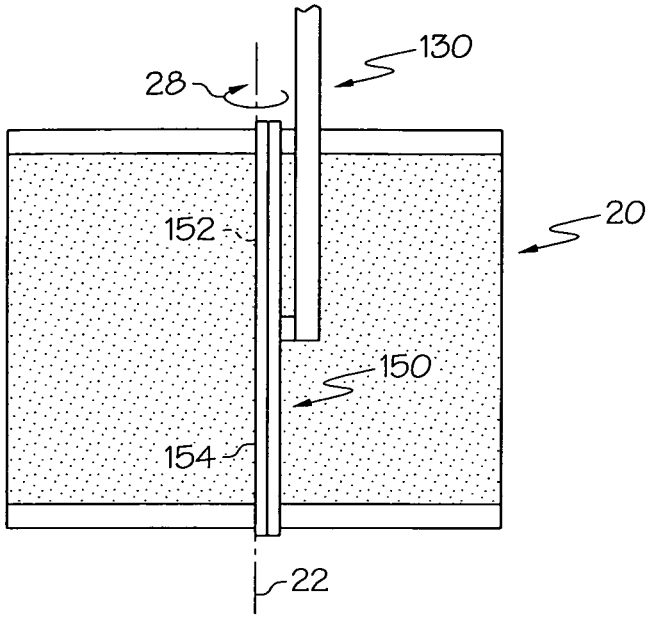
FIG. 13 is a side view of portions of the apparatus and honeycomb body of FIG. 9 illustrating the contact line between the working edge of the blade and the cement mixture being substantially straight and substantially parallel to the longitudinal axis of the honeycomb body.
Figure 14:
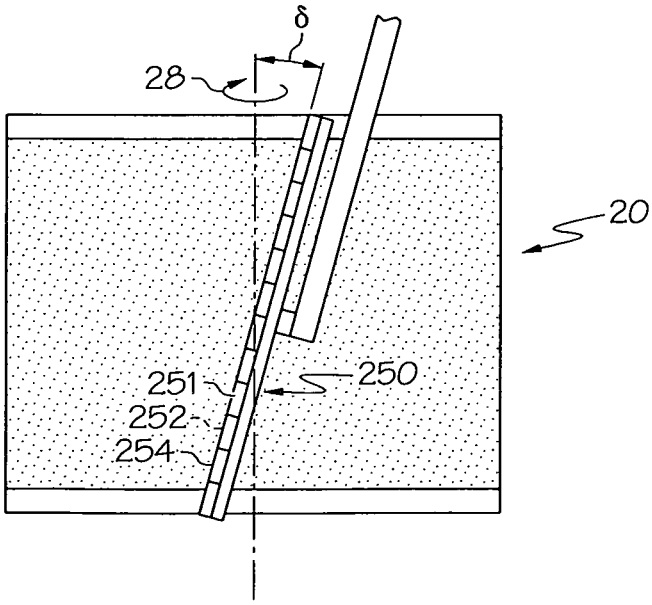
FIG. 14 is a side view of portions of another apparatus illustrating another example of the blade and further illustrating the contact line between the working edge of the blade and the cement mixture being substantially straight and substantially oblique to a direction of the longitudinal axis of the honeycomb body.

As shown in FIGS. 2 and 6, the blade 150 can include a working edge 152 configured to be disposed in proximity to the cylindrical surface 26 and contact the cement mixture 30 along a contact line 154 transverse to a relative rotation direction 28. As shown in FIG. 13, the contact line 154 can be substantially straight. In further examples, the contact line may have one or more curved shapes (e.g., sinusoidal shapes), angular shapes or other configurations. As further shown in FIG. 13, the contact line 154 can be substantially parallel to the longitudinal axis 22 of the honeycomb body 20. FIG. 14 illustrates a schematic view of another example blade 250 that can be used in accordance with aspects of the present invention. As shown, the blade 250 can include a working edge 252 configured to be disposed in proximity to the cylindrical surface 26. As shown, the contact line 254 can be substantially straight but may have one or more curved shapes (e.g., sinusoidal shapes), angular shapes or other configurations in further examples. As further shown, the contact line can be substantially oblique to a direction of the longitudinal axis of the honeycomb body. For example, as shown in FIG. 14, the contact line 254 can extend at an oblique angle $\delta$ with respect to the direction of the longitudinal axis 22.

Figure 5A:
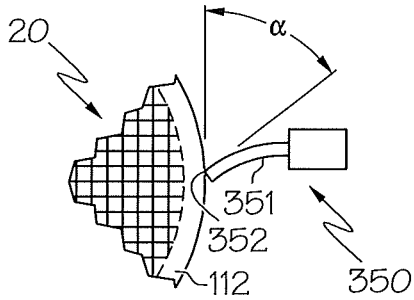
FIG. 5A is a partial sectional view similar to FIG. 5 with an alternative blade configuration.

The blade can have a wide variety of configurations to facilitate desirable contact with the cement mixture. As shown in FIG. 6, the blade 150 can include a working member 151 provided with the working edge 152. The working member 151 can be supported by an optional support member 153 such as the illustrated ferrule. The working member 151 can comprise a wide variety of structures. As shown in FIGS. 2 and 5, the working member can comprise a substantially rigid planar member although other nonplanar members may be used in further examples. As shown in the alternative embodiment of FIG. 5A, the blade 350 can include a substantially flexible working member 351 wherein an interior angle (e.g., interior angle $\alpha$) can be defined relative to the line of tangency at the working edge 352 of the working member 351. As shown in FIG. 14, the working member 251 can also comprise a segmented working member such as bristles, paddles or other segmented portions.

As shown in FIGS. 5-9, methods of the present invention can orient the blade 150 in a first position wherein the blade forms a first interior angle $\alpha$ with the cylindrical surface 26 in an upstream direction 158 from the contact line 154. The blade 150 can be oriented in the first position before or after contacting the cement mixture 30 with the blade 150. Moreover, the blade 150 can be oriented in the first position before, during and/or after a relative rotation of the honeycomb body 20 with respect to the blade 150 about the longitudinal axis 22. In one example, the first interior angle $\alpha$ is an acute angle. For example, the first interior angle $\alpha$ can be from about 20° to about 80°, such as from about 45° to about 75°. For instance, the first interior angle $\alpha$ can be from about 55° to about 65°. Examples of the present invention can select the first interior angle $\alpha$ to enhance the surface quality of the cement mixture layer 32.

The method of the present invention can further hold the blade 150 in the first position during a relative rotation of the honeycomb body 20 and the blade 150 about the longitudinal axis 22. In one example, a plurality of dispensing devices and blades, such as diametrically opposed dispensing devices and blades, can be configured to work together to provide the desired layer with less than a 360° rotation. As shown in FIGS. 5-9, the blade 150 can be held in the first position during at least a 360° rotation of the honeycomb body 20 relative to the blade 150 about the longitudinal axis 22.

As shown, the dispensing device 140 can be located in the upstream direction 158 from the contact line to facilitate sufficient formation of the cement mixture layer 32. Still further, although the dispensing device and blade are illustrated as separate members, it is contemplated that a single device may include both the blade and the dispensing device. Such a configuration may reduce the number of parts and can also reduce the rotation of the honeycomb body 20 about the longitudinal axis 22 when the blade 150 is held in the first position. Indeed, the cement mixture 30 could exit the dispensing device on the blade or may quickly contact the blade as the cement is applied to the cylindrical surface 26.

Figure 9:
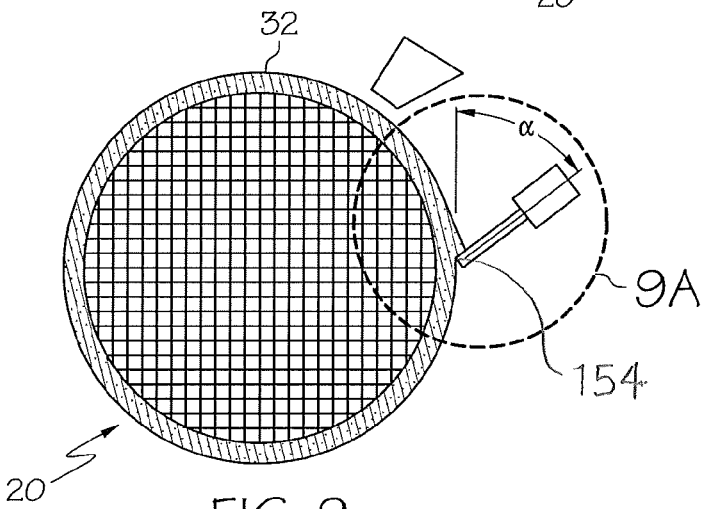
FIG. 9 is a sectional view similar to FIG. 8 with the apparatus still further rotating such that the cement mixture layer is formed over substantially the entire cylindrical surface of the honeycomb body.

As shown in FIG. 9 contact between the blade 150 and the cement mixture 30 can result in a cement mixture layer 32 covering at least part, such as substantially the entire, cylindrical surface 26 of the honeycomb body 20.

Figure 10:
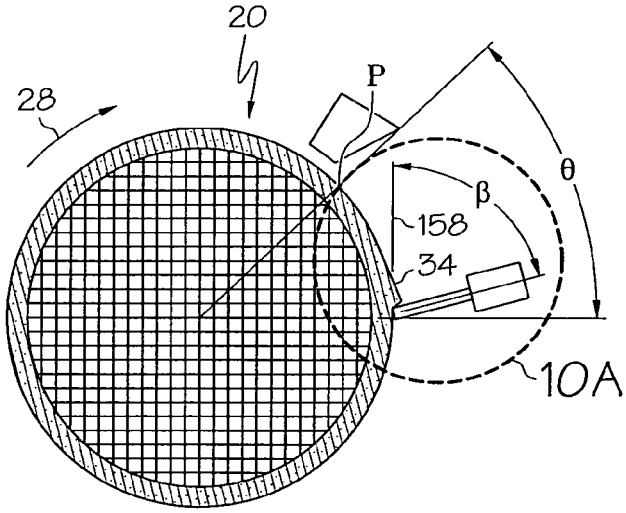
FIG. 10 is a sectional view similar to FIG. 9 illustrating the blade forming a second interior angle with the cylindrical surface in the upstream direction.
Figure 11:
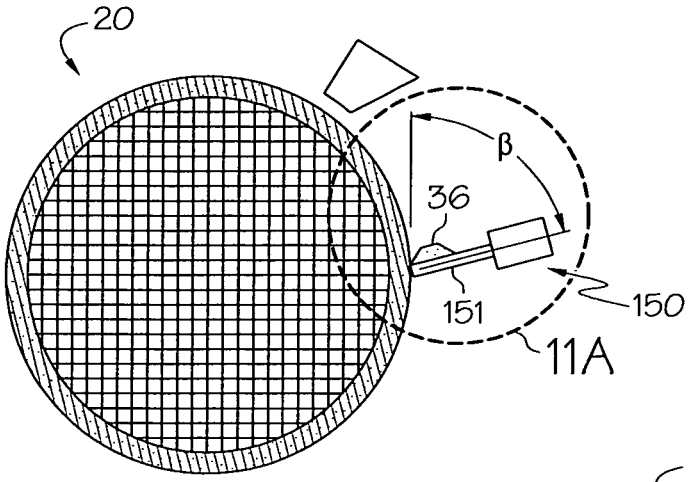
FIG. 11 is a sectional view similar to FIG. 10 illustrating removal of the tail of the cement mixture layer by further rotating the honeycomb body with the blade at the second interior angle.
Figure 11A:
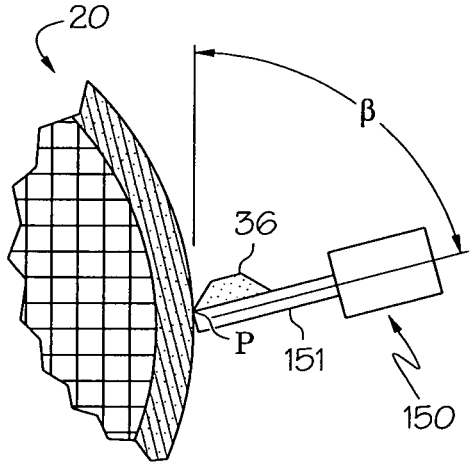
FIG. 11A is an enlarged view of portions of FIG. 11.

As shown in FIGS. 10-11, the method of the present invention can further move the blade 150 from the first position to a second position wherein the blade 150 forms a second interior angle $\beta$ with the cylindrical surface 26 in the upstream direction 158 from the contact line 154. As shown, the second interior angle $\beta$ is greater than the first interior angle $\alpha$. In one example, the second interior angle $\beta$ is an acute angle. For example, the second interior angle $\beta$ can be from about 40° to about 90°, such as from about 65° to about 90°. For instance, the second interior angle $\beta$ can be from about 75° to about 85°. Examples of the present invention can select the second interior angle $\beta$ to facilitate removal a tail portion 34 of the cement mixture layer 32 extending in the upstream direction 158.

Optionally, the blade 150 can move from the first position to the second position while rotating the honeycomb body 20 and the blade 150 relative to one another about the longitudinal axis 22. For example, methods of the present invention can involve little or no relative rotation between the honeycomb body 20 and the blade 150 about the longitudinal axis 22 as the blade 150 moves from the first position toward the second position. For instance, there may be no relative rotation between the honeycomb body 20 and the blade 150 about the longitudinal axis 22 as the blade 150 moves from the first position to the second position. In further examples, significant relative rotation between the honeycomb body 20 and the blade 150 about the longitudinal axis 22 can occur as the blade moves from the first position towards the second position. For instance, relative rotation between the honeycomb body 20 and the blade 150 about the longitudinal axis 22 can continue while the blade 150 moves from the first position to the second position. If the blade 150 moves quickly during the transition, relatively little relative rotation about the longitudinal axis 22 occurs from the first position to the second position. However, if the blade 150 moves slowly during the transition, a relatively large relative rotation about the longitudinal axis 22 can occur from the first position to the second position.

Figure 9A:
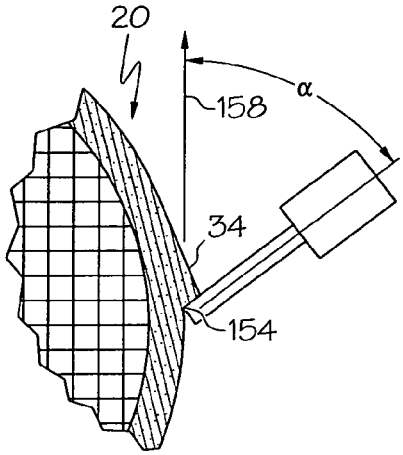
FIG. 9A is an enlarged view of portions of FIG. 9 illustrating a tail of the cement mixture layer extending in the upstream direction.

Once the blade 150 begins to move from the first position toward the second position, methods of the present invention can provide further relative rotation between the honeycomb body 20 and the blade 150 about the longitudinal axis 22. Such relative rotation can occur entirely before or entirely after the blade 150 reaches the second position. In further examples, the relative rotation can occur at least partially before and at least partially after the blade 150 reaches the second position. In the illustrated example, a significant portion of the relative rotation can occur after the blade 150 reaches the second position. For example, as shown in FIGS. 9 and 9A, the cement mixture layer 32 is fully formed. There may be no relative rotation between the honeycomb body 20 and the blade 150 about the longitudinal axis 22 as the blade 150 moves from the first position to the second position shown in FIGS. 10 and 10A. Alternatively, the honeycomb body 20 and the blade 150 can rotate relative to one another about the longitudinal axis 22 while the blade 150 quickly moves from the first position to the second position. Once reaching the second position, example methods can provide that the honeycomb body 20 and the blade 150 with a further relative rotation through an angle θ about the longitudinal axis 22. Some embodiments include a further relative rotation sufficient to remove the tail portion 34. In such examples, the angle θ can be less than about 5°. In other examples, however, the angle θ can be greater than 5°.

Once the point "P" is reached, contact between the blade 150 and the cement mixture 30 can be terminated. The honeycomb body 20 and the blade 150 can have a relative rotation through an angle θ before contact between the blade 150 and the cement mixture 30 is terminated. Thus, contact between the blade 150 and the cement mixture 30 can be maintained after the blade 150 reaches the second position. In further examples, contact between the blade 150 and the cement mixture 30 can be terminated once the blade 150 reaches the second position without significant further relative rotation between the honeycomb body 20 and the blade 150 about the longitudinal axis 22. Contact between the blade 150 and the cement mixture can also be maintained during relative rotation of the honeycomb body 20 and the blade 150 about the longitudinal axis 22 before and after the blade 150 reaches the second position.

Figure 12:
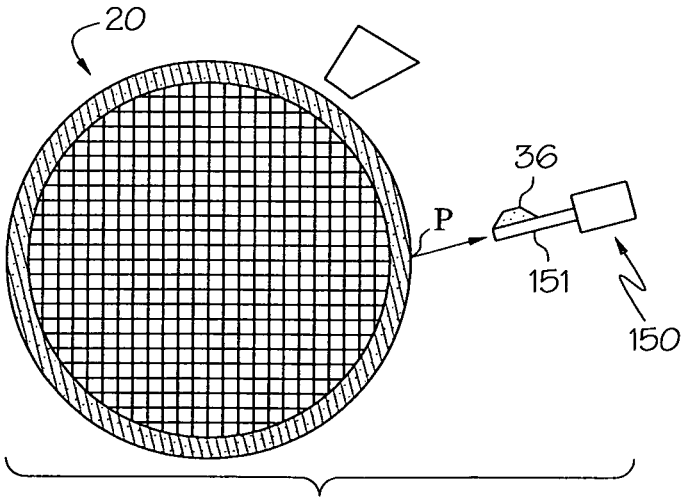
FIG. 12 is a sectional view similar to FIG. 11 wherein contact between the blade and the cement mixture is terminated with a portion of the cement mixture being disposed on the blade.

As shown in FIG. 12, contact between the blade 150 and the cement mixture 30 can be terminated with a portion 36 of the cement mixture 30 being disposed on the blade 150, whereas the portion 36 of the cement mixture 30 can be removed from the cylindrical surface 26 of the honeycomb body 20. Thus, the tail portion 34 of the cement mixture layer 32 extending in the upstream direction 158 can be removed.

Various apparatus can be used to help apply a cement mixture to the cylindrical surface 26 of the honeycomb body 20. For example, as shown in FIGS. 1-4, the apparatus 100 can be provided with the dispensing device 140, the blade 150, a first support member 110 and a second support member 112. The first and second support member 110, 112 can include a shape that is geometrically similar to the shape of the corresponding end faces 24*a*, 24*b* of the honeycomb body 20. The apparatus 100 can include a motor 102 configured to drive the second support member 112 to rotate about a rotation axis that can extend along the longitudinal axis 22 of the honeycomb body 20. In further examples, another motor can be provided to rotate the first support member 110 by way of drive shaft 113. Although not shown, an alignment device may be provided to align the longitudinal axis 22 of the honeycomb body 20 with the rotation axis of the first and second support member 110, 112. In further examples, the first support member 110 can be aligned independent from the second support member 112. For example, the first support member 110 can be aligned with respect to the first end face 24*a* of the honeycomb body and the second support member 112 can be independently aligned with the second end face 24*b* of the honeycomb body 20. In one example, apparatus and/or alignment devices discussed in U.S. Patent Application No. PCT/US2008/002813, filed Feb. 29, 2008, can be used in accordance with aspects of the present invention, wherein the entire disclosure in incorporated by reference in its entirety.

The apparatus 100 can further include an optional computer 120 configured to control operations of the apparatus. The computer can actuate the drive shaft 113 to move downward such that the end faces 24*a*, 24*b* are gripped by the respective support members 110, 112 as shown in FIG. 2. As further illustrated in FIG. 2, a support arm 130 may be provided to support the blade 150 of the apparatus 100. FIG. 2 illustrates a schematic view of the support arm 130 with a first actuator 132 configured to orient the position of the blade 150 with respect to the support members 110, 112 and a second actuator 134 configured to further orient the position and angle of the blade 150 with respect to the other portions of the support arm. The first actuator 132 and/or the second actuator 134 can be controlled by the computer 120.

An example method of applying a layer to the honeycomb body 20 will now be described. Initially, the honeycomb body 20 can be placed and centered on the second support member 112 such that the longitudinal axis 22 of the honeycomb body 20 is aligned with the rotational axis of the first and second support members 110, 112. Next, the computer 120 can actuate the first support member 110 to move down by way of the drive shaft 113. As shown in FIG. 2, once appropriately positioned, the end faces 24*a*, 24*b* of the honeycomb body 20 are gripped with the respective support members 110, 112. As shown in FIGS. 2 and 5, each the peripheral edges 110*a*, 112*a* of each respective support member 110, 112 includes an outer dimension "D" that is larger than an outer dimension "d" of the cylindrical surface 26. As further illustrated in FIGS. 2 and 5, the working edge 152 simultaneously engages the peripheral edges 110*a*, 112*a* of the respective support members 110, 112 to create a space 156 with a depth "t" between the working edge 152 and the cylindrical surface 26. Blade 150 can slide along, or ride along, peripheral edges 110*a*, 112*a*. Thus, as shown, the peripheral edges 110*a*, 112*a* can act as guide members to space the working edge 152 and preventing the working edge 152 from contacting the cylindrical surface 26 of the honeycomb body 20.

Figure 3:
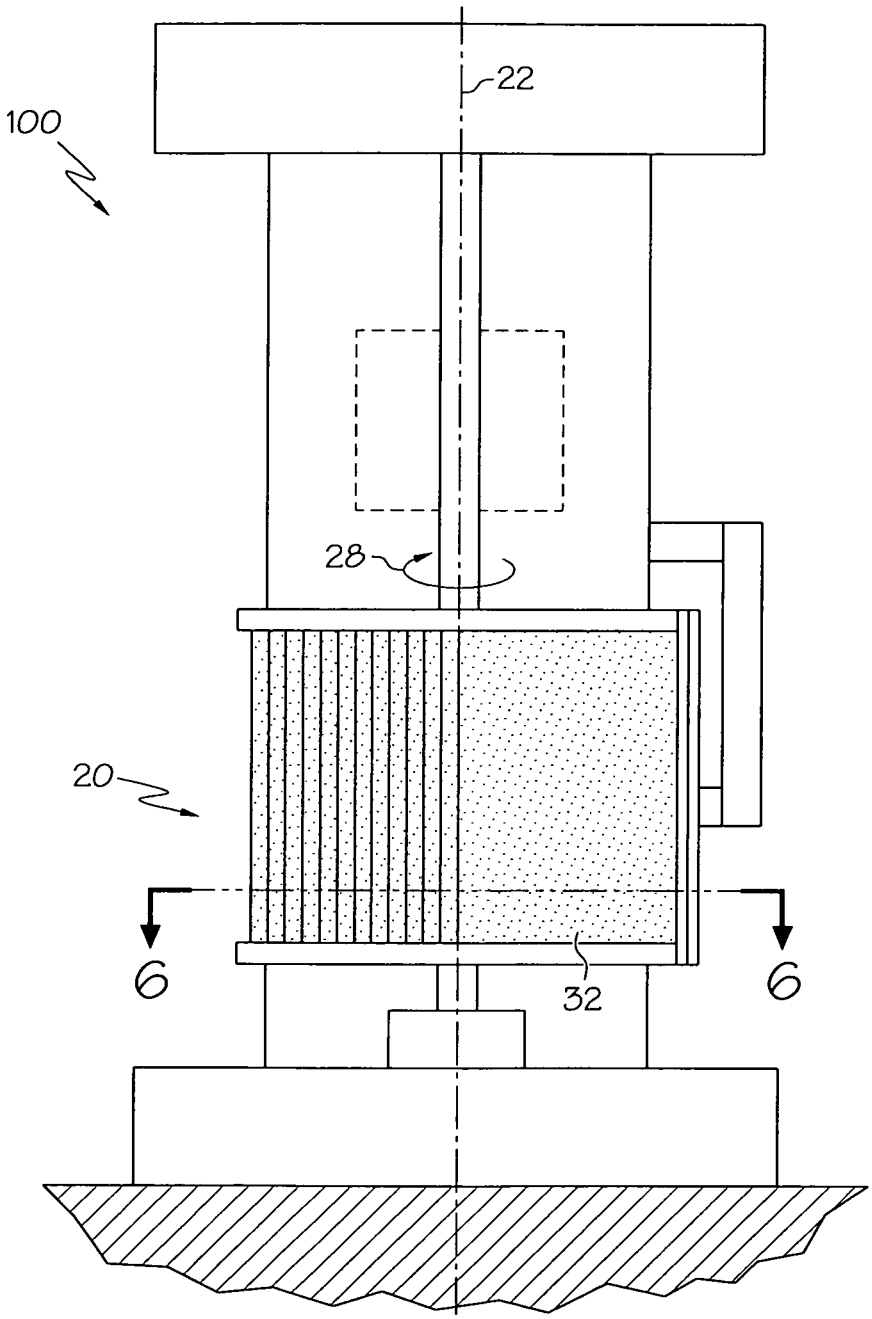
FIG. 3 is a schematic view of FIG. 2 with the apparatus further rotating such that the blade contacts the cement mixture while the honeycomb body rotates.
Figure 4:
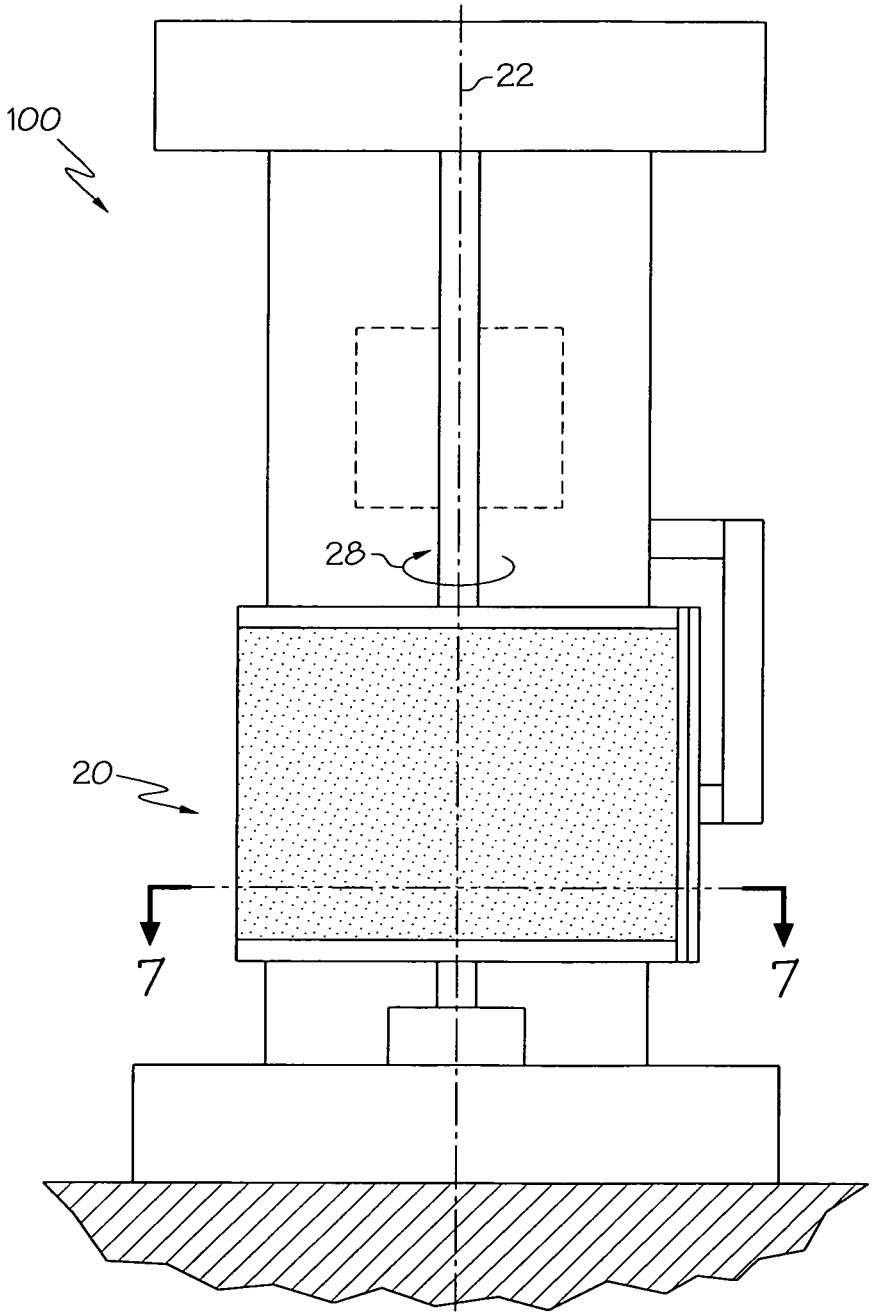
FIG. 4 is a schematic view of FIG. 3 with the apparatus still further rotating with the blade contacting the cement mixture.

As further shown in FIGS. 2 and 5, the computer 120 can send a command to the motor 102 to begin rotating the support members 110, 112 together with the honeycomb body 20 with respect to the base of the apparatus about the longitudinal axis 22 of the honeycomb body 20. Although not shown, the support member 110, 112 with the honeycomb body 20 may remain stationary while the blade 150 orbits about the honeycomb body 20. Still further, the honeycomb body 20 can be designed to rotate relative to the base and the blade 150 can be also designed to orbit about the honeycomb body 20. The computer 120 can also cause the cement mixture 30 to be applied to the cylindrical surface 26 of the honeycomb body 20. As shown in FIGS. 3 and 6, the space 156 between the working edge 152 and the cylindrical surface 26 can be filled by the cement mixture 30, for example, as the honeycomb body 20 rotates relative to the base. As shown, rotation of the honeycomb body 20 relative to the base can create a cement mixture layer 32 on the cylindrical surface 26 of the honeycomb body 20 having a thickness corresponding to the depth "t" of the space 156. Extra portions 33 of the cement mixture 30 can gather to provide a consistent cement mixture layer 32 without discontinuities in the outer surface of the cement mixture layer 32.

Figure 8:
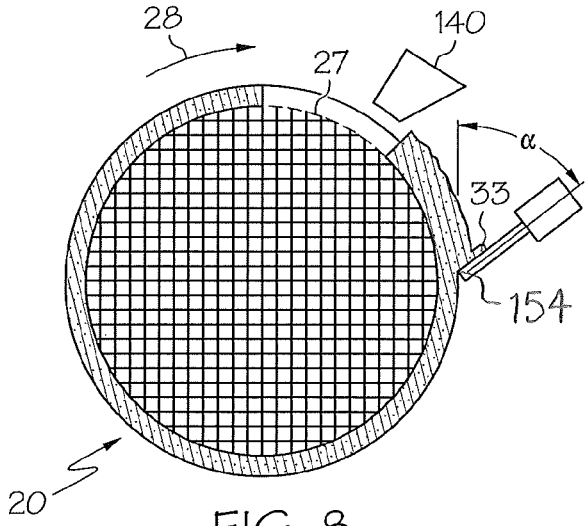
FIG. 8 is a sectional view similar to FIG. 7 with the apparatus still further rotating with the blade contacting the cement mixture without applying further cement mixture to the cylindrical surface by the dispensing nozzle.

FIGS. 3, 4, 6 and 7 illustrate an example where the honeycomb body 20 continues to rotate with respect to the base about the longitudinal axis 22 with a cement mixture layer 32 covering increasing portions of the cylindrical surface 26. As shown in FIG. 8, after a predetermined angle of rotation, the computer 120 can stop the flow of the cement mixture from the dispensing device 140 while the honeycomb body 20 continues to rotate relative to the base. As shown in FIG. 9, continued rotation causes the extra portions 33 of the cement mixture 30 to be spread over the remaining space to cover substantially the entire cylindrical surface 26 of the honeycomb body 20. As shown in FIG. 9A, a tail portion 34 extends in the upstream direction 158 of the interior angle.

Figure 10A:
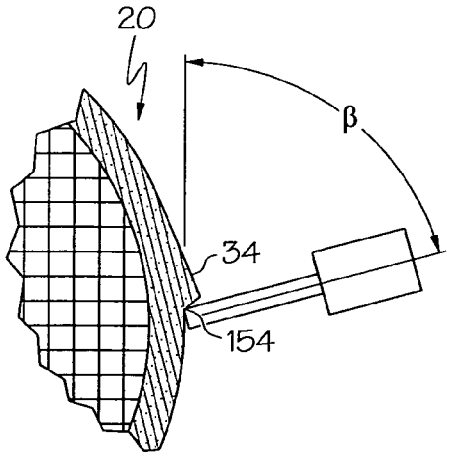
FIG. 10A is an enlarged view of portions of FIG. 10.

As illustrated in FIGS. 10-12, the tail portion 34 can be removed by orienting the blade 150 from the first position to the second position wherein the blade forms the second interior angle β greater than the first interior angle α. As shown in FIG. 10A, the contact line 154 engaged by the working edge 152 is the location of a seam defined by the tail portion 34. The tail portion 34 and corresponding seam can be removed by further rotating the honeycomb body 20 relative to the blade 150 such that the tail portion 34 rides up the working member 151 of the blade 150. As shown in FIG. 12, once completed, the blade 150 may be removed with a portion 36 of the cement mixture retained on the working member 151 of the blade 150.

It will therefore be appreciated that examples of the present invention may include rotating the honeycomb body 20 and the blade 150 relative to one another about the longitudinal axis 22. For example, as shown in the drawings, the honeycomb body 20 can be rotated relative to the base about the longitudinal axis 22 while the blade 150 remains substantially stationary relative to the base of the apparatus 100. In another example, the honeycomb body 20 can remain stationary relative to the base of the apparatus 100 while the blade 150 orbits the honeycomb body 20. In still further examples, the honeycomb body 20 can rotate relative to the base about the longitudinal axis 22 while the blade 150 orbits the honeycomb body 20. In yet further examples, the honeycomb body 20 can rotate relative to the base about the longitudinal axis 22 during at least one operation while the blade 150 remains stationary relative to the base. In another operation, the blade 150 can orbit the honeycomb body while the honeycomb body 20 remains stationary relative to the base. For example, a procedure can be conducted with the honeycomb body 20 rotating relative to the base about the longitudinal axis 22 with the blade being stationary with respect to the base and oriented in the first position to enhance the surface quality of the cement mixture layer 32. During a subsequent procedure, the honeycomb body 20 can remain stationary relative to the base of the apparatus 100 while the blade 150 orbits the honeycomb body with the blade in the second position to remove the tail portion 34.

Figure 15:
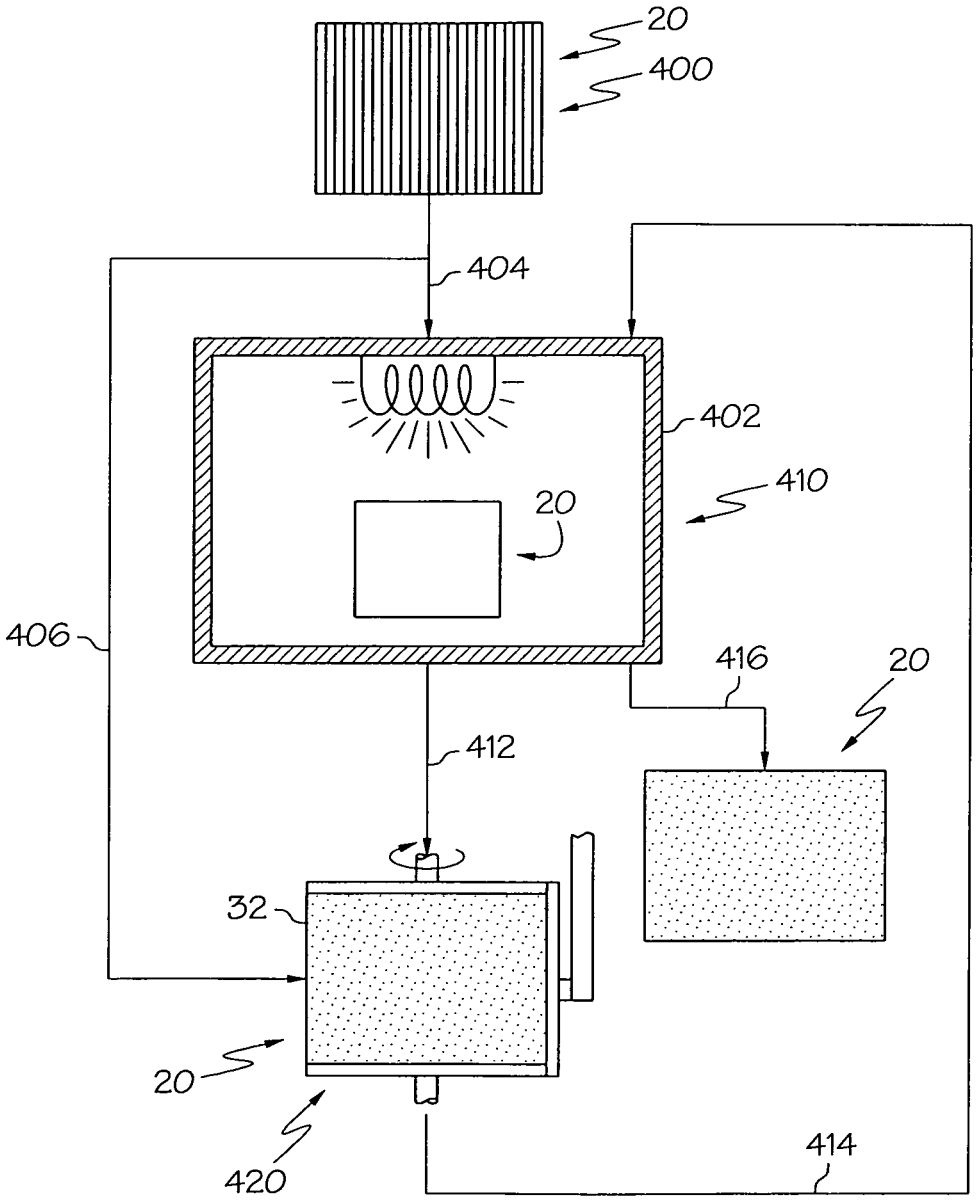
FIG. 15 is a schematic view of example methods of applying a layer to the honeycomb body.

FIG. 15 illustrates a schematic view of a method of applying a layer to the honeycomb body 20. As shown, the honeycomb body 20 can be provided at step 400. The honeycomb body 20 at step 400 can comprise a green body of ceramic material formed, for example, during an extruding process. As represented by process path 404, in one example, the green honeycomb body 200 can be dried and placed within a heating chamber 402. Once positioned within the heating chamber 402, a firing sequence can be conducted during firing step 410. As represented by process path 412, the cement mixture layer 32 can then be applied to the fired honeycomb body during step 420. The cement mixture layer 32 can then be cured, for example, by heating to dry or fire the cement material. For example, as represented by process path 414, the cement mixture layer 32 be placed within the heating chamber 402 to dry the cement mixture layer 32. Drying can be achieved at 140° F. although other drying temperatures may be used in further examples. Alternatively, the cement mixture layer 32 may be dried with ambient air temperatures within or outside of the heating chamber 402. Once complete, the cured honeycomb body 20 can be removed from the heating chamber 402 as shown by process path 416.

In a further example, as represented by process path 406, the cement mixture layer 32 can be initially added to the green honeycomb body 20 during step 420. As represented by process path 414, the green honeycomb body 20 and cement mixture layer 32 can be dried and then placed within the heating chamber 402 as represented by process path 414. A firing sequence can then be conducted during firing step 410 to form a fired honeycomb body 20 with an outer cured skin layer on the cylindrical surface of the honeycomb body. Once complete, the fired honeycomb body 20 can be removed from the heating chamber 402 as shown by process path 416.

In one aspect, a method of applying a layer to a honeycomb body is disclosed herein comprising a longitudinal axis extending through opposing end faces and a cylindrical surface extending about the longitudinal axis and between the end faces, the method comprising the steps of: applying a cement mixture to the cylindrical surface; rotating the honeycomb body and a blade relative to one another about the longitudinal axis; contacting the cement mixture with the blade while the honeycomb body and the blade rotate relative to one another, wherein a working edge of the blade is disposed in proximity to the cylindrical surface and contacts the cement mixture along a contact line transverse to a relative rotation direction, and the blade forms a first interior angle with the cylindrical surface in an upstream direction from the contact line; holding the blade at the first interior angle during a relative rotation of the honeycomb body and the blade about the longitudinal axis; then moving the blade from the first interior angle to a second interior angle with the cylindrical surface in the upstream direction from the contact line, the second interior angle being greater than the first interior angle; and further rotating of the honeycomb body and the blade relative to one another about the longitudinal axis after the blade begins to move from the first interior angle toward the second interior angle.

The step of rotating the honeycomb body and the blade relative to one another can include rotating the honeycomb body in a rotation direction about the longitudinal axis. The blade preferably remains substantially stationary during a rotation of the honeycomb body about the longitudinal axis.

Preferably, the first interior angle is an acute angle. In some embodiments, the first interior angle is from about 20° to about 80°. In other embodiments, the first interior angle is from about 45° to about 75°. In other embodiments, the first interior angle is from about 55° to about 65°.

In some embodiments, the second interior angle is an acute angle. In some embodiments, the second interior angle is from about 40° to about 90°. In some embodiments, the second interior angle is from about 65° to about 90°. In other embodiments, the second interior angle is from about 75° to about 85°.

In some embodiments, the working edge does not contact the cylindrical surface of the honeycomb body. In some embodiments, contact between the blade and the cement mixture is terminated when the blade reaches the second interior angle. In some embodiments, contact is maintained between the blade and the cement mixture after the blade reaches the second interior angle.

In some embodiments, the contact line is substantially straight. In some embodiments, the contact line is substantially parallel to the longitudinal axis of the honeycomb body.

In some embodiments, the cement mixture is applied while the honeycomb body and the blade rotate relative to one another.

In some embodiments, the cement mixture is applied while the honeycomb body and the blade rotate relative to one another and while contacting the blade with at least part of the cement mixture.

In some embodiments, contact between the blade and the cement mixture results in a cement mixture layer covering the cylindrical surface of the honeycomb body.

In some embodiments, the method further comprises the step of curing the cement mixture layer to form an outer skin layer on the cylindrical surface of the honeycomb body.

In some embodiments, contact between the blade and the cement mixture is terminated with a portion of the cement mixture being disposed on the blade, thereby removing the portion of the cement mixture from being disposed on the cylindrical surface of the honeycomb body.

In some embodiments, the method further comprises the step of gripping the end faces with respective support members, each support member including a peripheral edge with an outer dimension larger than a dimension of the cylindrical surface, wherein the working edge simultaneously engages the peripheral edges of the respective support members to create a space with a depth between the working edge and the cylindrical surface, wherein the space between the working edge and the cylindrical surface is filled by the cement mixture as the honeycomb body and the blade rotate relative to one another to create a cement mixture layer on the cylindrical surface of the honeycomb body having a thickness corresponding to the depth of the space.

In some embodiments, the honeycomb body comprises fired ceramic material. In other embodiments, the honeycomb body comprises a green body of ceramic material.

It will be apparent to those skilled in the art that various modifications and variations can be made in the present invention without departing from the spirit or scope of the invention. Thus, it is intended that the present invention cover the modifications and variations of this invention provided they come within the scope of the appended claims.

What is claimed is:

1. A method of applying a layer to a honeycomb body comprising a longitudinal axis extending through opposing end faces and a cylindrical surface extending about the longitudinal axis and between the end faces, the method comprising the steps of:

applying a cement mixture to the cylindrical surface;

rotating the honeycomb body and a blade relative to one another about the longitudinal axis;

contacting the cement mixture with the blade while the honeycomb body and the blade rotate relative to one another, wherein a working edge of the blade is disposed in proximity to the cylindrical surface and contacts the cement mixture at any point along a contact line transverse to a relative rotation direction, and the blade forms a first interior angle measured between a line parallel to a longitudinal length of the blade and a line extending upstream from the contact line and parallel to a tangent to the cylindrical surface, the tangent at the cylindrical surface most proximate to the contact line;

holding the blade at the first interior angle during a relative rotation of the honeycomb body and the blade about the longitudinal axis; then moving the blade from the first interior angle to a second interior angle measured between a line parallel to the longitudinal length of the blade and the line parallel to the tangent to the cylindrical surface, the second interior angle being greater than the first interior angle; and further rotating of the honeycomb body and the blade relative to one another about the longitudinal axis after the blade begins to move from the first interior angle toward the second interior angle;

wherein a distance between the cylindrical surface and the part of the working edge of the blade disposed most proximate to the cylindrical surface remains approximately constant during the movement of the blade from the first interior angle to the second interior angle.

2. The method of claim 1, wherein the step of rotating the honeycomb body and the blade relative to one another includes rotating the honeycomb body in a rotation direction about the longitudinal axis.

3. The method of claim 2, wherein the blade remains substantially stationary during a rotation of the honeycomb body about the longitudinal axis.

4. The method of claim 1, wherein the first interior angle is an acute angle.

5. The method of claim 4, wherein the first interior angle is from about 20° to about 80°.

6. The method of claim 5, wherein the first interior angle is from about 45° to about 75°.

7. The method of claim 6, wherein the first interior angle is from about 55° to about 65°.

8. The method of claim 1, wherein the second interior angle is an acute angle.

9. The method of claim 8, wherein the second interior angle is from about 40° to about 90°.

10. The method of claim 9, wherein the second interior angle is from about 65° to about 90°.

11. The method of claim 10, wherein the second interior angle is from about 75° to about 85°.

12. The method of claim 1 wherein the working edge does not contact the cylindrical surface of the honeycomb body.

13. The method of claim 1 wherein contact between the blade and the cement mixture is terminated when the blade reaches the second interior angle.

14. The method of claim 1 wherein contact is maintained between the blade and the cement mixture after the blade reaches the second interior angle.

15. The method of claim 1 wherein the contact line is oblique to the longitudinal axis of the honeycomb body.

16. The method of claim 1, wherein the contact line is substantially parallel to the longitudinal axis of the honeycomb body.

17. The method of claim 1, wherein the cement mixture is applied while the honeycomb body and the blade rotate relative to one another.

18. The method of claim 1, wherein the cement mixture is applied while the honeycomb body and the blade rotate relative to one another and while contacting the blade with at least part of the cement mixture.

19. The method of claim 1 wherein contact between the blade and the cement mixture results in a cement mixture layer covering the cylindrical surface of the honeycomb body.

20. The method of claim 1, further comprising curing the cement mixture layer to form an outer skin layer on the cylindrical surface of the honeycomb body.

21. The method of claim 1 wherein contact between the blade and the cement mixture is terminated with a portion of the cement mixture being disposed on the blade, thereby removing the portion of the cement mixture from being disposed on the cylindrical surface of the honeycomb body.

22. The method of claim 1, further comprising gripping the end faces with respective support members, each support member including a peripheral edge with an outer dimension larger than a dimension of the cylindrical surface, wherein the working edge simultaneously engages the peripheral edges of the respective support members to create a space with a depth between the working edge and the cylindrical surface, wherein the space between the working edge and the cylindrical surface is filled by the cement mixture as the honeycomb body and the blade rotate relative to one another to create a cement mixture layer on the cylindrical surface of the honeycomb body having a thickness corresponding to the depth of the space.

23. The method of claim 1, wherein the honeycomb body comprises fired ceramic material.

24. The method of claim 1, wherein the honeycomb body comprises a green body of ceramic material.

* * * * *